US005092484A

United States Patent [19]

Daugherty et al.

[11] Patent Number: 5,092,484

[45] Date of Patent: Mar. 3, 1992

[54] BIN FOR GRANULAR SUBSTANCE

[75] Inventors: Jonathan Daugherty, Winchester; Chester M. Kos, Cross Junction, both of Va.

[73] Assignee: Rubbermaid Commercial Products Inc., Winchester, Va.

[21] Appl. No.: 533,211

[22] Filed: Jun. 4, 1990

[51] Int. Cl.[5] ..... B65D 51/04

[52] U.S. Cl. ..... 220/331; 220/345; 220/659

[58] Field of Search ..... 220/331, 345, 346, 351, 220/307, 324, 657, 659

[56] References Cited

U.S. PATENT DOCUMENTS

| | | | |
|---|---|---|---|
| 2,661,119 | 12/1953 | Spiess, Jr. et al. | 220/331 |
| 4,230,381 | 10/1980 | Rhoades | 312/295 |
| 4,260,069 | 4/1981 | Juergens | 220/331 |
| 4,609,124 | 9/1986 | Malloy | 220/260 |
| 4,724,977 | 2/1988 | Cleevely et al. | 220/258 |
| 4,724,979 | 2/1988 | Cleevely et al. | 220/258 |
| 4,736,870 | 4/1988 | Christensson | 220/461 |
| 4,878,596 | 11/1989 | Cawley et al. | 220/331 |
| 4,887,735 | 12/1989 | Dudzik | 220/307 |
| 4,889,257 | 12/1989 | Steffes | 220/331 |

OTHER PUBLICATIONS

Page 52, Cambro Manufacturing Company, 7601 Clay Ave., P.O. Box 2000, Huntington Beach, Calif. 92647-2000. Publication date unknown.

Catalog Page, Silite Incorporated, 2600 N. Pulaski Rd., Chicago, Ill. 60639-2197. Publication date 1987.

Sell Sheet, Plastech International Inc., Box C-5050, John Fitch Industrial Park, Warminster, Pa. 18974. Publication date unknown.

Sell Sheet, Plastic Products, Division of Interplastic Corporation, 2123 NE. Broadway, Minneapolis, Minn. 55413-1775. Publication date unknown.

Sell Sheet, Plastic Products, Division of Interplastic Corporation, 2123 NE. Broadway, Minneapolis, Minn. 55413-1775. Publication date unknown.

Sell Sheet, Plastic Products, Division of Interplastic Corporation, 2123 NE. Broadway, Minneapolis, Minn. 55413-1775. Publication date unknown.

Sell Sheet, Plastic Products, Division of Interplastic Corporation, 2123 NE. Broadway, Minneapolis, Minn. 55413-1775. Publication date unknown.

Sell Sheet, Plastic Products, Division of Interplastic Corporation, 2123 NE. Broadway, Minneapolis, Minn. 55413-1775. Publication date unknown.

Page 6, Rubbermaid Commercial Products Inc., 3124 Valley Ave., Winchester, Va. 22601. Publication date 1989.

*Primary Examiner*—Gary E. Elkins
*Assistant Examiner*—Stephen Cronin
*Attorney, Agent, or Firm*—Richard B. O'Planick

[57] ABSTRACT

A bin for granular substance is disclosed comprising a receptacle (4) having an inwardly rolled top rim flange (14). The rim flange in turn defines an integral registration detent region (B). Rearward and forward lid components (38, 42) are mounted over the receptacle opening with the rearward lid component having a depending J-shaped appendages (30), which are located to extend below the below the receptacle of downturned rim flange (16). The forward lid component (38) is adapted having elements (52, 56) for sliding and pivotal engagement with the rearward lid component, whereby the forward lid component can be slidably repositioned along the rearward lid component, and at any position therealong, pivot upward to expose the receptacle top opening.

9 Claims, 3 Drawing Sheets

BIN FOR GRANULAR SUBSTANCE

BACKGROUND OF THE INVENTION

1. Field of the Invention

The subject invention relates generally to all-purpose bins used for holding and transporting various dry and wet substances. In one particular usage, such bins find application as storage containers for dry or wet foodstuffs.

2. The Prior Art

Bins for granular substances for the containment and transportation of dry and wet foodstuffs, such as cooking ingredients, are generally well known. Typically such bins comprise a top opening base container, and a lid mounted thereover. The lid consists of forward and rearward components, hingedly connected at a mid-section of the top opening such that the forward lid component pivots upward to access the interior cavity of the base container. Both the base and the lid components are comprised of plastics material, conventionally molded. The base container has an upward rim over which the lid components rest, whereby the lid components are freely removable from the top of the bin in order to access the entire opening. A commercially available bin of the aforementioned description is sold by Rubbermaid Commercial Products Inc., 3124 Valley Avenue, Winchester, Virginia 22601, under Part No. 3603.

While the above described bin works well and has been commercially well received, certain shortcomings prevent it from representing an ideal solution to the market's requirements. First, an outward roll in the upper rim of the base container represents wasted space when several bins are stored adjacent to one another. Secondly, the outward turn of the upper rim of the base container makes spillage more likely as ingredients in the bin are scooped upward toward the opening. Additionally, a loose placement of the lids over the top of the base container opening creates a situation where the lids are easily dislocated by jarring or the like, and can fall away from the base container, whereby exposing the contents of the container to the environment.

SUMMARY OF THE INVENTION

The aforementioned shortcomings of commercially available bin for granular substances are overcome by the subject invention, which provides for a receptacle having an inwardly rolled top rim flange. The rim flange in turn has an integral registration detent region formed therein. Rearward and forward lid components are mounted over the receptacle opening with the rearward lid component having a depending J-shaped appendage, which is located to extend below the receptacle downturned rim flange. So positioned the rearward lid component can slide along the receptacle rim flange, until intersection of a rear tab on the back of the lid and the rear rim is effected, yet the J-shaped appendage prevents an upward separation of the rearward lid component from the receptacle. The forward lid component is adapted having means for sliding and pivotal engagement with the rearward lid component, whereby the forward lid component can be slideably repositioned along the rearward lid component, and at any position therealong, pivot upward to expose the receptacle top opening. The internal roll of the upper rim serves to deter spillage by preventing escape of contents scooped upwardly along the receptacle sides.

Accordingly, it is an objective of the present invention to provide a bin for granular substance having structural means for preventing spillage when granular or liquid substances are withdrawn from the bin receptacle.

Still a further objective is to provide a bin for granular substance having forward and rearward coupled lid components, and structural means for securing the lid components to the top opening of a bin receptacle.

Still a further object is to provide a bin for granular substance having a forward lid component pivotally coupled to a rearward lid component, whereby upward pivotal motion of the forward lid component exposes a forward portion of the bin receptacle top opening.

Still further, it is an objective to provide a bin for granular substance having a forward lid component slideably coupled to a rearward lid component, and pivotal upward relative thereto independently of the position of the forward lid component along the rearward lid component.

Yet a further objective of the present invention is to provide a bin for granular substance having integral means for registering forward and rearward lid components to a top rim of the bin receptacle.

Yet a further objective of the present invention is to provide a bin for granular substance comprising a receptacle base and lid components which are economically and readily manufactured out of conventional plastics material and which require no hardware for assembly by the consumer.

These and other objectives, which will be apparent to one skilled in the art, are achieved by a preferred embodiment which is described in detail below, and which is illustrated in the accompanying drawings.

DESCRIPTION OF THE PREFERRED EMBODIMENT

Figure 1:
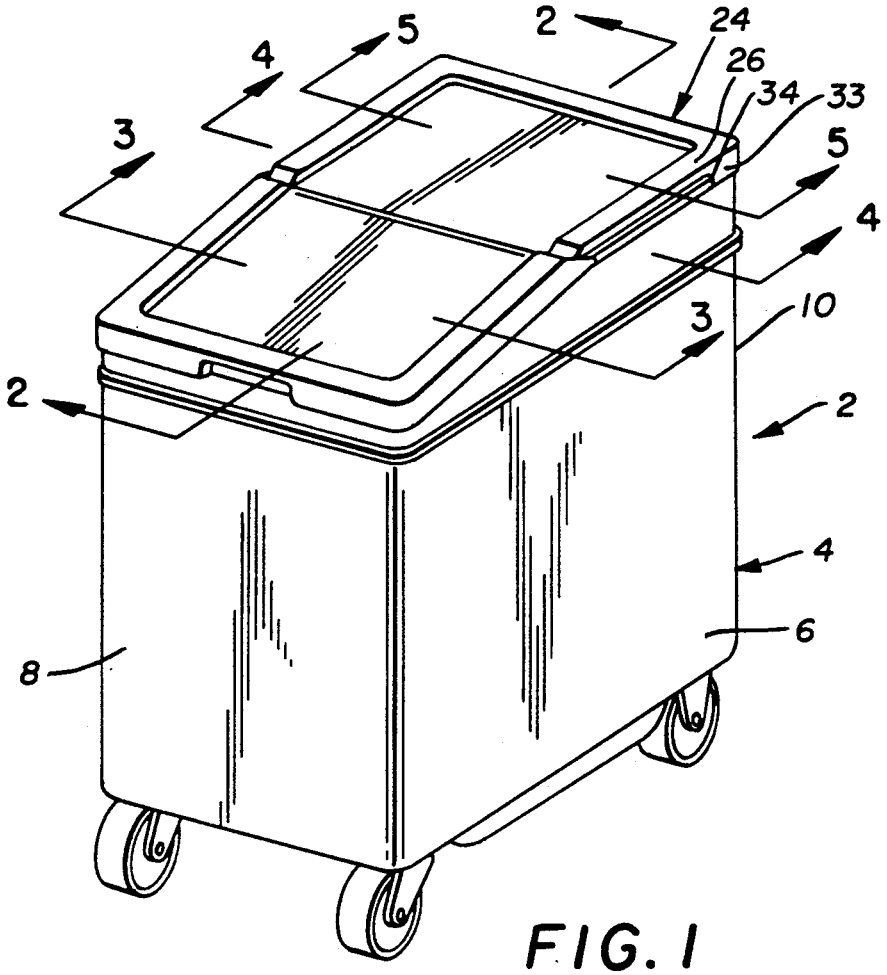
FIG. 1 is an assembled front perspective view of the subject bin for granular substance, showing the forward and rearward lid components in their normal state of enclosure.
Figure 2:
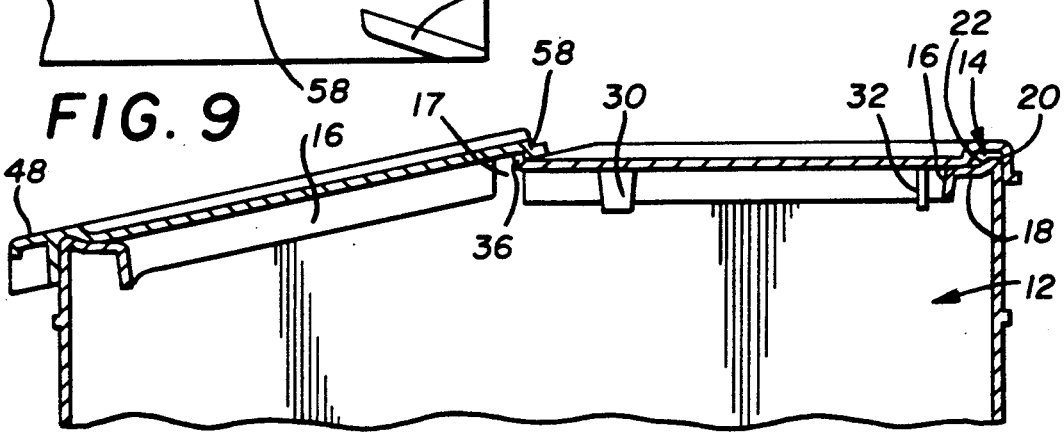
FIG. 2 is a longitudinal section view through the assembled bin for granular substance illustrated in FIG. 1 taken along the line 2—2.
Figure 4:
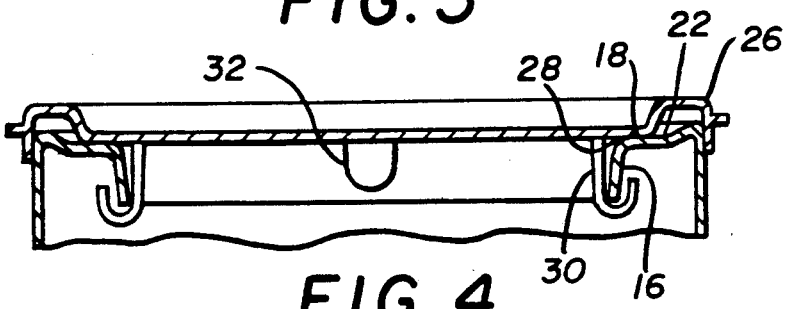
FIG. 4 is a transverse section view through the rearward lid component taken along the line 4—4 of FIG. 1.

Referring initially to FIGS. 1, 2, and 4, the subject bin for granular substance assembly 2 is shown to comprise a base receptacle 4, having vertically upright sidewalls 6, forward and rearward endwalls 8, 10, and an internal chamber 12 defined thereby. The internal chamber 12 terminates at an upper rim flange 14, which rolls inwardly, and then downward to an inwardmost edge flange 16. As shown best by FIG. 4, the rim flange 14 further includes an intermediate support surface 18 which merges into an elevated longitudinal ridge 20 extending along the outward edge of the base receptacle 6.

With continued reference to FIGS. 1, 2, 4, and 5, as best observed from FIG. 2, a detent 22 is defined by the space which the intermediate support surface 18 is recessed below the longitudinally extending ridge 20. By being stepped below ridge 20, intermediate support surface 18 thereby serves as a registration detent for the purpose explained below. The upper rim flange 14 is interrupted at the midpoint thereof by relief openings 17 at opposite sides of the receptacle, to facilitate assembly of the rearward lid component to the receptacle, as explained below.

A rearward lid component 24 is provided having a peripheral rim portion 26, of generally horizontal disposition, outlining the outward periphery of the lid component 24. An intermediate surface 28 of rearward lid member 24 is generally horizontal, and recessed below rim portion 26. Surface 28 provides an underside surface from which a pair of J-shaped appendages 30 project. As shown best by FIG. 4, appendages 30 extend downwardly from intermediate surface 28, proximate the outward sides thereof, with the free ends of J-shaped appendages 30 being directed outwardly. Situated to the rear, and positioned to the middle of intermediate surface 28 of rearward lid component 24, is a downwardly depending U-shaped flange 32.

Figure 6:
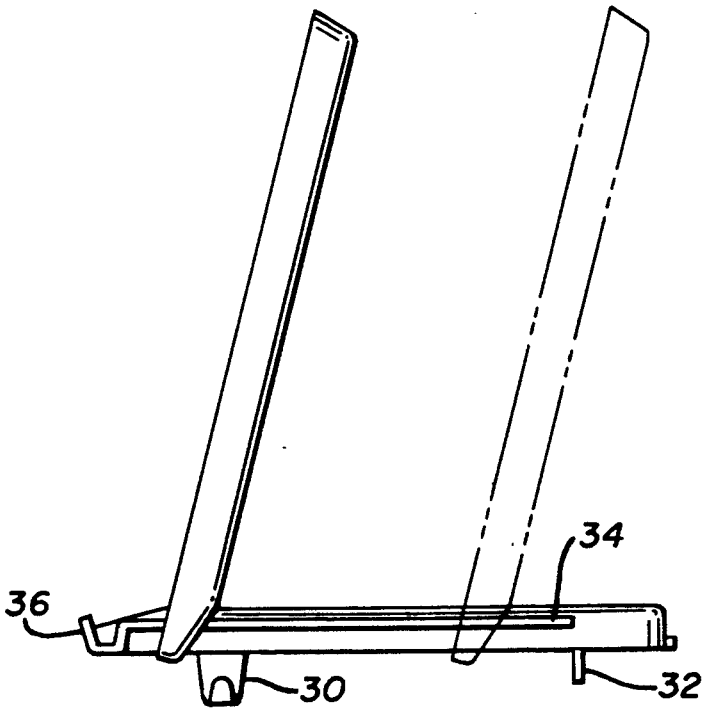
FIG. 6 is a side elevational view of the forward and rearward lid components, shown with the forward lid component in an upwardly pivoted (open) condition.
Figure 7:
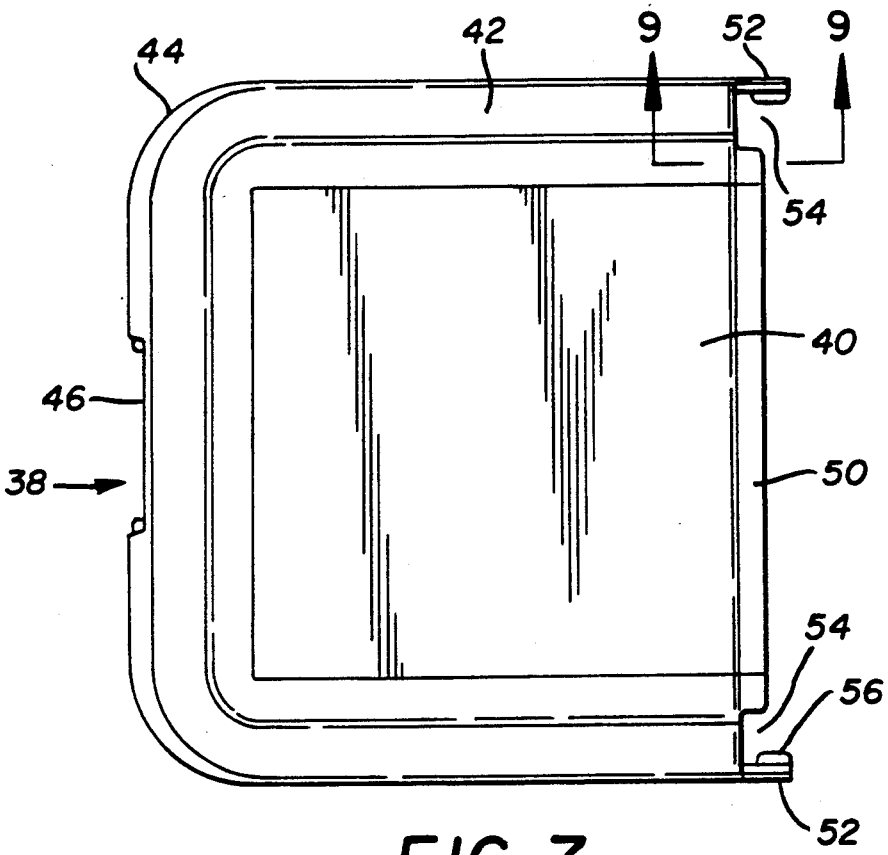
FIG. 7 is a top plan view of the forward component.
Figure 8:
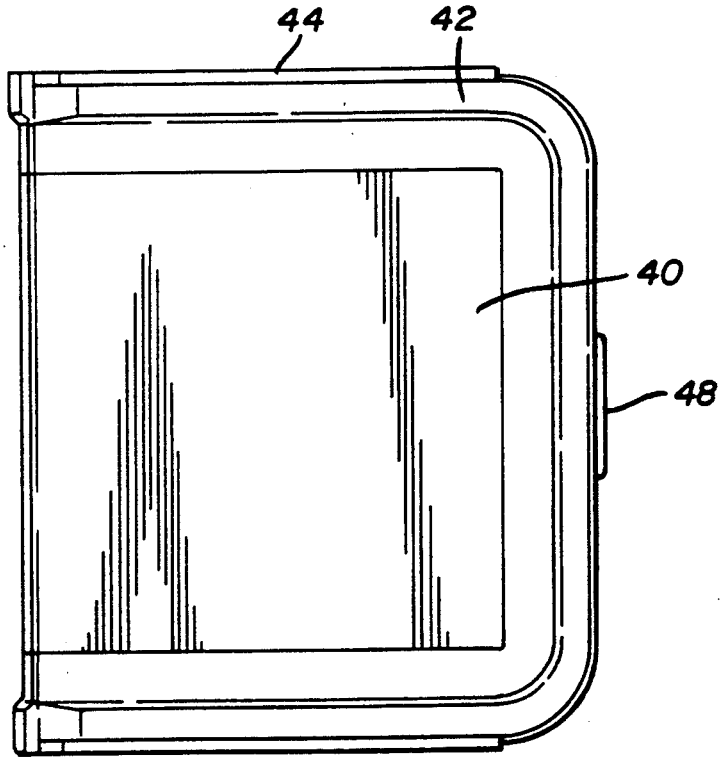
FIG. 8 is a bottom plan view of the forward lid component.

Each down turned edge flange side 33 of rearward lid component 24 is adapted having a longitudinally extending retention flange 34 extending outwardly therefrom. Flange 34 is of generally rectangular longitudinal section, disposed to extend substantially the length of each lid side 33. An upturned forward lip flange 36 is formed in rearward lid member 24, as best shown in FIG. 2 and FIG. 6. The purpose of lip flange 36 will be readily appreciated from the explanation below.

Proceeding to a consideration of FIGS. 1, 2, 7, and 8, the forward lid component 38 is seen to comprise a central body 40 of generally planar rectangular configuration. A peripheral rim flange 42 outlines the border of the central surface 40, and integrally merges with a downturned edge flange 44. An intermediately disposed hand opening 46 is provided in a forward portion of downturned edge flange 44. A finger grip flange 48, as shown in FIG. 2, is provided to facilitate a finger gripping grasp of the forward lid component 24.

At rearward corners of the forward lid component 38 are backwardly projecting cantilevered retention flanges 52. Cantilever flanges 52 are separated from the central body 40 of rearward lid component 24 by openings 54. A hinge flange projection 56 extends inwardly from the free end of each of the retention flanges 52. As will be appreciated from FIG. 4, the hinge flanges 56 are elongate rectangular flanges which angle upwardly from remote free ends of the retention flange projections 52 toward a forward end of the rearward lid component 24.

Figure 3:
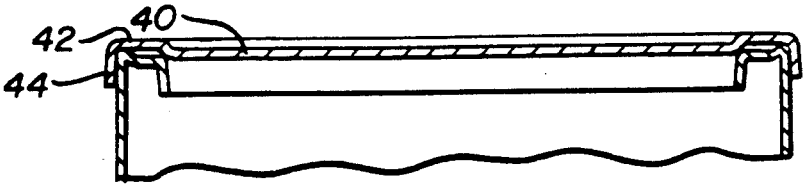
FIG. 3 is a transverse section view through the forward lid component depicted in FIG. 1, taken along the line 3—3.

Operation and assembly of the subject bin for granular substance proceeds as follows. With reference to FIGS. 2, 3, and 4, the lid assembly begins with the mounting of the rearward lid component 24 to the top opening of the receptacle 4. Assembly of the rearward lid component 24 is initiated by the insertion of J-shaped appendages 30 through the relief openings 17 in the edge flange 16 of receptacle 4 (See FIG. 2), and underneath the edge flange 16. Thereafter, the rearward lid component 24 is moved backward toward the rear of the container, which movement terminating when the U-shaped stop 32 encounters the rearward portion of edge flange 16. As will be appreciated, J-shaped appendages 30 prevent the rearward lid component 24 from being vertically separated from the receptacle 4, and stop 32 prevents further rearward sliding of the rearward lid component 24 from its position on top of the receptacle 4. As shown in FIG. 4, in its final position, the intermediate surface 28 of rearward lid member 24 rests upon the intermediate support surface 18 of the rim flange 14. Accordingly, the rearward lid component 24 registers with the upper rim flange 14, and ridge 20 prevents the rearward lid component 24 from dislocating. So positioned, rearward lid member 24 is precluded from rearward and upward separation from receptacle 4, and, by operation of ridge 20, from excessive lateral movement.

The forward lid component 38 attaches from the rear of the rearward lid component 24, by placing the hinge flanges 56 under the longitudinal retention flanges 34 of the rearward lid component 24, and sliding the forward lid component 38 forward. As shown in FIG. 2, engagement between downturned edge lip 58 of the forward lid component 38, and upturned forward lip 36 of the rearward lid component 24, terminates the forward movement of forward lid component 38 relative to rearward lid component 24. In the forwardmost position, the forward lid component 38 encloses the forward portion of the receptacle chamber 12.

As will be appreciated from FIG. 2, the upper profile of the receptacle 4 angles downwardly from its intermediate point toward the front. A user can therefore pivot the forward lid component 38 upwardly, and gain easy access to the contents stored in chamber 12. The downward angle of the upper forward lip of receptacle 4 will be seen to bifurcate the top opening of chamber 12.

Figure 5:
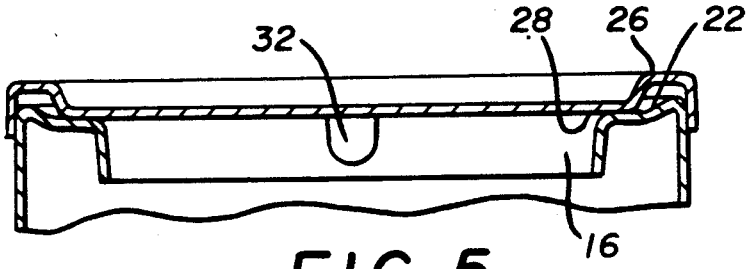
FIG. 5 is a transverse section view of the rearward lid component taken along the line 5—5 of FIG. 1.

From FIGS. 3, 4, and 5, it will be readily apparent that the inwardly rolled upper rim flange 14 of the receptacle 4 serves a dual purpose. First, by rolling inwardly, the capacity of the receptacle 4 is maximized, relative to the width dimension of the receptacle. Since the rim flange does not project outwardly from the receptacle body, the space taken by the rim flange does not subtract from the capacity of the container. Further, bin receptacles configured pursuant to the present invention can be stored in side by side configuration, in abutment, thereby making maximum utilization of available storage space. The inwardly rolled rims do not interfere with side by side abutting contact. Secondly, it will be appreciated that the inward roll of upper rim flange 14 serves to prevent the escape of the contents from the receptacle 4. The inward roll of upper rim flange 14 serves to prevent spillage as the contents of receptacle 4 are scooped upwardly against sidewall 6, or forward endwall 8.

The receptacle body is conventionally molded of plastic, preferably polyethylene, and the forward and rearward lid components are likewise conventionally molded, preferably of polycarbonate plastics material. Apart from the casters (see FIG. 1) which are provided at bottom corners of the bin receptacle (at the option of the user), the subject receptacle 4 and lid components 24 and 38 are capable or assembly and use without the need for assembly hardward.

Figure 9:
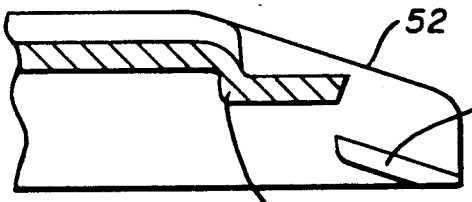
FIG. 9 is a section view through the right rearward corner of the forward lid component, taken along the line 9—9 of FIG. 7.

Finally, it will be appreciated from FIGS. 1, 6, and 9, that forward lid component hinge flanges 56 reside below rearward lid component flanges 34, whereby enabling forward lid 38 to slide backwardly atop rearward lid 24, as shown in FIG. 6. At any relative position, forward lid 38 can be pivoted upwardly about flanges 56 into an over-vertical, upright, and stable position. The inclination of flanges 56 retain lid 38 in its upright over vertical condition until equilibrium is manually disturbed, and the lid 38 is pivoted forward.

While the above describes the preferred embodiment of the subject invention, the present invention is not to be so restricted. Other embodiments which utilize the teachings herein set forth, are intended to be in the scope and spirit of the subject invention.

We claim:

1. A bin for granular substance comprising:

a. a receptacle having sidewalls and a bottom surface cooperatively defining an internal chamber and a top chamber opening, said sidewalls having an inwardly rolled upper rim flange; said receptacle rim flange having substantially an inverted U-shape, comprising an intermediate surface portion and in inwardmost dependent free flange portion terminating at a downward edge;

b. lid means comprising coupled forward and rearward lid components for enclosing said top chamber opening, said lid means having downwardly directed connection means comprising at least one J-shaped dependent appendage which extends below and engages said receptacle rim flange downward edge, whereby maintaining said lid means fixedly connected to said receptacle, and said lid means further comprising a downwardly directed surface located outward of said J-shaped appendage, adapted for registered positionment upon said receptacle rim intermediate surface portion.

2. A bin according to claim 1, wherein said forward lid component pivots upward to expose a portion of said top chamber opening.

3. A bin according to claim 2, wherein said forward lid component is slideably repositionable along said rearward lid component, whereby exposing to a variable degree said receptacle chamber.

4. A bin for granular substance comprising:

a. a receptacle having side walls and a bottom surface cooperatively defining an internal chamber opening to a top of the receptacle, the side walls having an inwardly rolled upper rim flange, defined by an inwardmost downturned edge flange and an intermediate support surface portion having registration means for seating a lid component thereupon;

b. a rearward lid component for enclosing a rearward portion of the internal chamber, and having an upraised rim portion receivable over the receptacle upper rim flange, and having an upraised rim portion receivable over the receptacle upper rim flange, and having an underside surface for seated positionment upon said receptacle flange intermediate support surface;

c. said rearward lid component having at least one depending J-shaped appendage extending below said receptacle downturned edge flange and positioned to facilitate a sliding movement of said rearward lid component along said receptacle upper rim flange, and preventing an upward separation of said rearward lid component from said receptacle.

5. A bin as set forth in claim 4, wherein said registration means comprising an elongate ridge extending along an outward edge of said receptacle upper rim flange, adjacent to and elevated above said intermediate support surface.

6. A bin as set forth in claim 5, wherein said bin having a forward lid component for enclosing a forward portion of said internal chamber, said forward lid component having an upraised peripheral rim flange for positionment over the receptacle upper rim flange.

7. A bin as set forth in claim 6, wherein said forward lid component having coupling means at a rearward end for hinged connection to said rearward lid component.

8. A bin as set forth in claim 7, wherein said coupling means comprising: an elongate longitudinal retention flange extending along an outward surface of said rearward lid component upraised rim portion, and said forward lid component having a rearwardly directed cantilevered flange projection at least one rearward corner thereof, slideably retained below said rearward lid longitudinal retention flange whereby said forward lid component being slideably repositionable along said rearward lid component in superior relation thereto, and said cantilever flange having an inwardly direct pivot projection extending therefrom.

9. A bin as set forth in claim 8, wherein said forward lid component pivoting vertically open about said pivot projection, independently of the position of said forward lid component relative to said rearward lid component.

* * * * *